US007478901B1

(12) United States Patent
Myers et al.

(10) Patent No.: US 7,478,901 B1
(45) Date of Patent: Jan. 20, 2009

(54) CONTAINER HAVING FLUIDICALLY SEGREGATED COMPARTMENTS

(75) Inventors: John A Myers, Corvallis, OR (US); Sherman S. Wong, Corvallis, OR (US); Joseph R Elliot, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 420 days.

(21) Appl. No.: 10/975,261

(22) Filed: Oct. 27, 2004

(51) Int. Cl.
*B41J 2/175* (2006.01)

(52) U.S. Cl. ..... 347/86; 347/87

(58) Field of Classification Search ..... 347/84–87
See application file for complete search history.

(56) References Cited

U.S. PATENT DOCUMENTS

| | | | |
|---|---|---|---|
| 4,771,295 | A | 9/1988 | Baker |
| 4,931,811 | A | 6/1990 | Cowger |
| 5,025,271 | A | 6/1991 | Baker |
| 6,095,643 | A | 8/2000 | Cook |
| 6,186,621 | B1 | 2/2001 | Pew |
| 6,293,665 | B1 | 9/2001 | Pew |
| 6,328,424 | B1 | 12/2001 | Denton |
| 6,460,985 | B1 | 10/2002 | Olsen |
| 2001/0009432 | A1 | 7/2001 | Olsen |
| 2002/0021340 | A1 | 2/2002 | Olsen |
| 2004/0145637 | A1 * | 7/2004 | Hwang et al. ..... 347/86 |

FOREIGN PATENT DOCUMENTS

| | | |
|---|---|---|
| WO | WO 99/56960 | 11/1999 |

OTHER PUBLICATIONS

Picture-2 pgs: Dell print cartridge J740 P/N T0722 commercially purchased.
Picture-2 pgs: Lexmark 10N0016 print cartridge commercially purchased.
Picture-2 pgs: Lexmark 18L0032 print cartridge commercially purchased.
Picture-2 pgs: Lexmark 17G0050 print cartridge commercially purchased.

* cited by examiner

*Primary Examiner*—Stephen D Meier
*Assistant Examiner*—Rene Garcia, Jr.

(57) ABSTRACT

A fluid container, including a body having a base surface, a capillary fluid volume disposed over the base surface, and an outlet compartment having at least one outlet wall disposed within the body and extending from the base surface into the capillary fluid volume. The body also includes at least two fluidically segregated free fluid compartments, where each compartment includes at least one sidewall disposed within the body. The at least one sidewall includes a compression edge wherein at least a portion of the compression edge is flush with the at least one outlet wall edge.

62 Claims, 8 Drawing Sheets

- PRIOR ART -

- PRIOR ART -

- PRIOR ART -

CONTAINER HAVING FLUIDICALLY SEGREGATED COMPARTMENTS

BACKGROUND

Description of the Art

Substantial developments have been made in the micro-manipulation of fluids in fields such as electronic printing technology using inkjet printers. Fluid ejection cartridges and fluid supplies provide good examples of the problems facing the practitioner in preventing the formation of gas bubbles in the supply container, microfluidic channels, and chambers of the fluid ejection cartridge. The fluid supply in inkjet printing systems is just one common example.

Currently there is a wide variety of highly efficient inkjet printing systems in use, which are capable of dispensing ink in a rapid and accurate manner. Generally a printhead is mounted to a carriage that is moved back and forth across a print media, a print controller activates the printhead to deposit or eject ink drops onto the print media to form images and text. Ink must be delivered to the printhead by an ink supply that is either carried by the carriage or mounted to the printing system in a fixed manner, typically, with a flexible ink delivery system connected between the supply and the printhead.

There has been a demand by consumers for ever-increasing improvements in speed, image quality and lower cost in printing systems. In an effort to reduce the size of ink jet printers and to reduce the cost per printed page, efforts have been made to optimize the performance of three basic configurations: 1) print cartridges with integral reservoirs, 2) small semi-permanent or permanent printheads with replaceable ink reservoirs mounted on the printheads, and 3) small semi-permanent or permanent printheads with a fixed ink supply that is either continuously connected or intermittently connected to the printhead. For the last case the ink supply is mounted off of the carriage and either connected to the printhead via a flexible conduit providing continuous replenishment or else intermittently connected by positioning the printhead proximate to a filling station that facilitates connection of the printhead to the ink supply. In the first case the entire printhead and ink supply is replaced when the ink is exhausted. In the second case the ink supply is separately replaceable, and is replaced when exhausted and the printhead may be replaced at the end of printhead life. Regardless of where the ink supply is located within the printing system, it is desirable that the ink supply reliably, efficiently, and cost effectively deliver as much of the total volume of ink contained in the supply to the printhead as possible.

An example of an inkjet cartridge with an integral fluid supply is shown in FIGS. 1*a*-1*c*. The fluid supply of print cartridge 102 consists of unitary cartridge body 121 that is configured to hold free ink in printhead support section or snout region 112 and to hold ink in porous media section 114 as shown in a cross-sectional view in FIG. 1*b*. Standpipe 139, shown in a top-plan view in FIG. 1*a* and in cross-sectional views in FIGS. 1*b*-1*c* generally has filter 156 mounted to the top portion of the standpipe. Ink stored in the porous media section flows through filter 156 into standpipe 139 as ink is ejected from the printhead (not shown). Typically, printhead support region 112 will have several support members such as standpipe supports 125*a*, 125*b*, 125*c*, and 125*d* which increase the rigidity of both the standpipe and the printhead support section in general, providing greater resistance to cracking of the printhead when the print cartridge is subjected to shock such as through inadvertent dropping. In addition, the ink delivery system of such a print cartridge should function properly in the presence of shaking, vibration, trapped air, particle contamination, and a broad range of operating temperatures and pressures.

In addition to providing ink to the printhead, the ink supply also provides additional functions. Typically, replaceable ink supplies are provided with seals over the fluid interconnects to prevent ink leakage and evaporation, and contamination of the interconnects during distribution and storage. In addition, the ink supply also provides for some pressure regulation to deliver the ink to the printhead at the optimum backpressure (i.e. a negative pressure). The printing system strives to maintain the backpressure of the ink within the printhead to within as small a range as possible. The backpressure needs to be sufficiently negative so that the head pressure associated with the ink supply is kept at a value that is lower than the atmospheric pressure to prevent leakage of ink from either the ink supply or the printhead, such leakage is typically referred to as drooling. In addition, the ink supply should provide a backpressure over a wide range of temperatures and atmospheric pressures to which the printhead may be subjected in storage, shipment, and operation.

Changes in back pressure, of which air bubbles are only one variable, may greatly effect print density as well as print and image quality. In addition, even when not in use the volume of air entrapped in a fluid supply may increase when subjected to stress such as dropping. Subsequent altitude excursions typically cause this air to expand and displace ink ultimately leading to the displaced ink being expelled from the supply container. The expelled ink will cause damage to the product package or other container in which it is located.

If these problems persist, the continued growth and advancements in inkjet printing and other micro-fluidic devices, seen over the past decade, will be reduced. Current ink supply technology continually struggles with maximizing the amount of ink delivered for a given container size while continuing to meet shipping stress and altitude specifications. Consumer demand for cheaper, smaller, more reliable, higher performance devices constantly puts pressure on improving and developing cheaper, and more reliable manufacturing materials and processes. There is an ever present need for ink supplies which make use of low cost materials and are relatively easy to manufacture. In addition, there is a continuing desire for ink containers that are volumetrically efficient producing compact ink supplies that provide for ever smaller printing systems. The ability to optimize fluid ejection systems, will open up a wide variety of applications that are currently either impractical or are not cost effective.

DESCRIPTION OF THE PREFERRED EMBODIMENTS

Figure 1A:
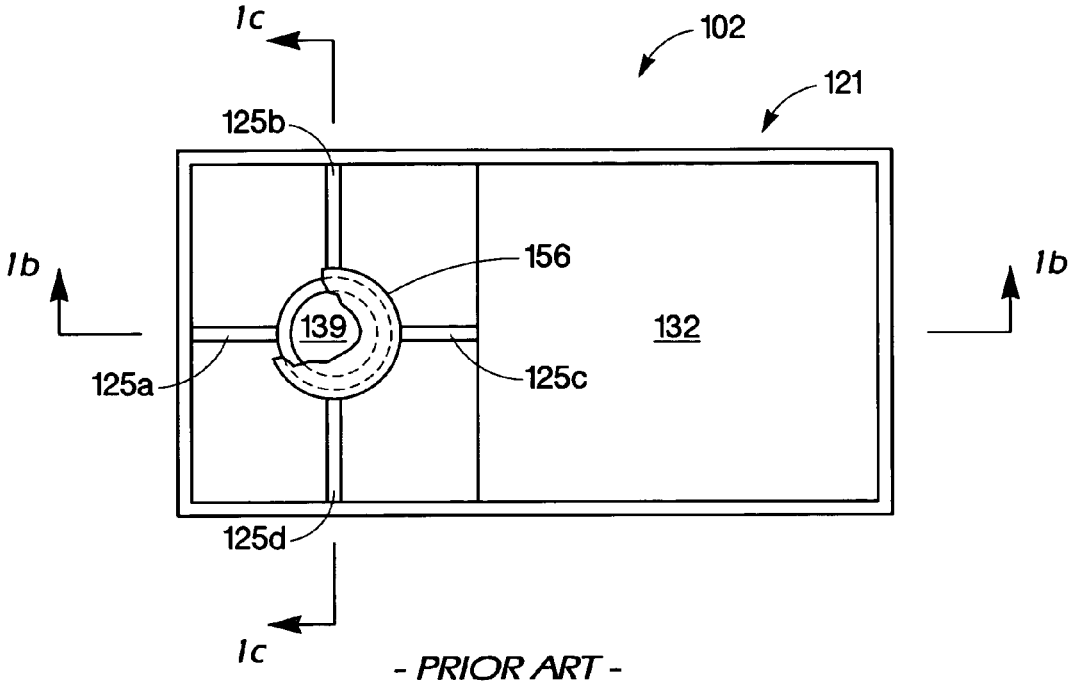
FIG. 1*a* is a top plan view of a prior art print cartridge storing ink in a free ink section and a porous media section.

This invention is directed to various fluid containers and fluid ejection cartridges that utilize, for fluid containment, a volume of capillary material along with a free fluid chamber. The present invention provides a container or cartridge that reduces the amount of free fluid that can be displaced by air from a given air path or leakage path reaching the free fluid volume. If gaps, between the capillary material and the edges of the container or cartridge, allow air to reach the free fluid, the capillary force in the capillary material will draw the free fluid into the material until the material is saturated to the point the material stops absorbing fluid into it. Once the capillary material is saturated the excess free fluid can leak out through vent holes or outlet ports, or in the case of cartridges through the nozzles of the fluid ejector head and drool out of the container or cartridge potentially causing damage. In addition, during either or both increases in ambient temperature or deceases in air pressure, any air trapped within the container or cartridge will expand further exacerbating this drool problem.

The present invention advantageously utilizes a free fluid chamber partitioned into compartments with each compartment defined by various combinations of the peripheral walls of the container, compartment sidewalls and a surface of the capillary material. Each compartment sidewall has a compression region that extends into the capillary material. The volume of capillary material defines a fluid capillary volume of the container or cartridge. The compression region of the compartment sidewall compresses the capillary material along the compression region. These compressed cells of the capillary material have a higher capillary pressure, which causes them to saturate with fluid preferentially over less-compressed cells. The saturated cells adjacent to the compression region of each sidewall severely hinder and/or restrict air from migrating beyond the particular sidewall with which it comes in contact. Such a structure allows for over ten percent of the fluid stored in the container or cartridge to be stored as free fluid outside the capillary material. The combination of partitioning the free fluid chamber into at least two compartments, and the utilization of the compression regions of the compartment sidewalls hinders and/or limits an air path from reaching more than the 1 compartment exposed to the air path. This limitation allows the capillary material to continue to function properly since the capillary material absorbs only the smaller amount of free fluid contained in the one compartment and does not absorb the entire amount of free fluid held within the container or cartridge.

The present invention reduces the amount of capillary material utilized to provide a given amount of fluid to a customer. In addition, it allows the use of less expensive simple geometric shapes of capillary material such as simple cylinders, cubes, and rectangular shapes rather than more complex shapes that fill the entire volume of the container or cartridge. Further, since up to about twenty percent of the fluid absorbed by the capillary material may remain in the material at the end of life, the amount of fluid filled into a container or cartridge is increased by the amount held in the free fluid chamber. However, the amount of fluid stranded in the container or cartridge is not increased thereby providing for a higher percentage of the volume of fluid contained to be dispensed.

It should be noted that the drawings are not true to scale. Further, various elements have not been drawn to scale. Certain dimensions have been exaggerated in relation to other dimensions in order to provide a clearer illustration and understanding of the present invention. In particular, vertical and horizontal scales may differ and may vary from one drawing to another. In addition, although some of the embodiments illustrated herein are shown in two dimensional views with various regions having height and width, it should be clearly understood that these regions are illustrations of only a portion of a device that is actually a three dimensional structure. Accordingly, these regions will have three dimensions, including length, width, and height, when fabricated on an actual device.

Moreover, while the present invention is illustrated by various embodiments, it is not intended that these illustrations be a limitation on the scope or applicability of the present invention. Further, it is not intended that the embodiments of the present invention be limited to the physical structures illustrated. These structures are included to demonstrate the utility and application of the present invention to presently preferred embodiments.

Figure 2A:
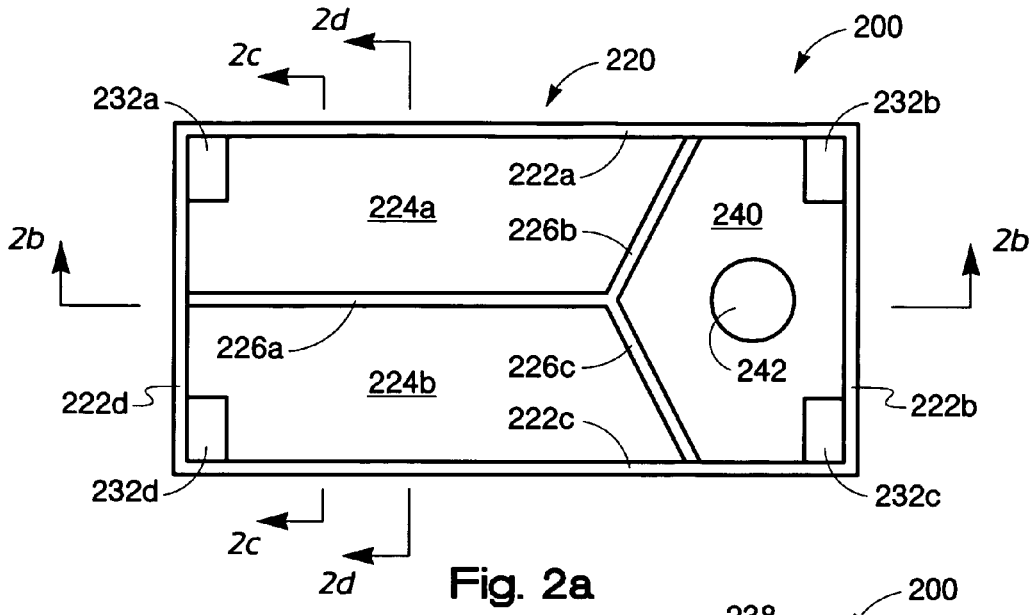
FIG. 2*a* is a top plan view of a fluid container according to an embodiment of the present invention.

A top plan view of an embodiment of fluid container 200 employing the present invention is illustrated in FIG. 2*a*. In this embodiment, fluid container 200 includes body 220 configured to contain a fluid. Body 220 has straight or vertical body sidewalls 222*a*, 222*b*, 222*c*, and 222*d*; however, in alternate embodiments, body 220 may have sloping sidewalls that provide for easy insertion of a capillary material such as capillary material 218 (see FIG. 2*d*). In addition, although body 220 is depicted as having a rectangular shape, body 220 may have any of a variety of different shapes and configurations. In this embodiment, body 220 is formed by injection molding utilizing a polyethylene terephthalate polymer (PET) that is 15 percent filled with glass; however, in alternate embodiments, any suitable metal, glass, ceramic, or polymeric material that is compatible with the fluid being stored also may be utilized. For example, polypropylene, polyethylene, liquid crystal polymers, glass, stainless steel, and aluminum are just a few materials that also may be utilized to form body 220.

Body 220 includes capillary material stops 232*a*, 232*b*, 232*c*, and 232*d* on which capillary material 218 is supported. The volume above the capillary material stops is the capillary fluid volume. In this embodiment, body 220 also includes free fluid compartments 224*a* and 224*b* which form a free fluid chamber. In alternate embodiments, the free fluid chamber may be partitioned into any reasonable number of free fluid compartments. Free fluid compartment 224*a* is formed by body sidewalls 222*a* and 222*d* and free fluid compartment sidewalls 226*a* and 226*b*. Free fluid compartment 224*b* is formed by body sidewalls 222*c* and 222*d* and free fluid compartment sidewalls 226*a* and 226*c*. Free fluid compartment sidewalls 226*a* and 226*b* and free fluid compartment sidewalls 226*a* and 226*c* each intersect at an angle of about 120 degrees; however, in alternate embodiments, the free fluid compartment sidewalls may intersect at other angles less than about 120 degrees. The actual angle utilized will depend on the amount of free fluid volume held in container 200 and the surface tension of both the fluid being stored and the surface free energy of the sidewall material. Larger angles, generally will be less efficient in generating a capillary path where the sidewalls intersect. The capillary path is advantageous for efficient uptake of the free fluid stored in that compartment. In addition, body 220 further includes outlet compartment 240 formed by body sidewalls 222*b*, 222*a*, and 222*c* and free fluid compartment sidewalls 226*b* and 226*c*. Outlet compartment 240 also includes fluid outlet 242 formed in body sidewall 222*e* through which fluid held in container 200 is dispensed as illustrated in FIG. 2*b*.

Figure 2B:
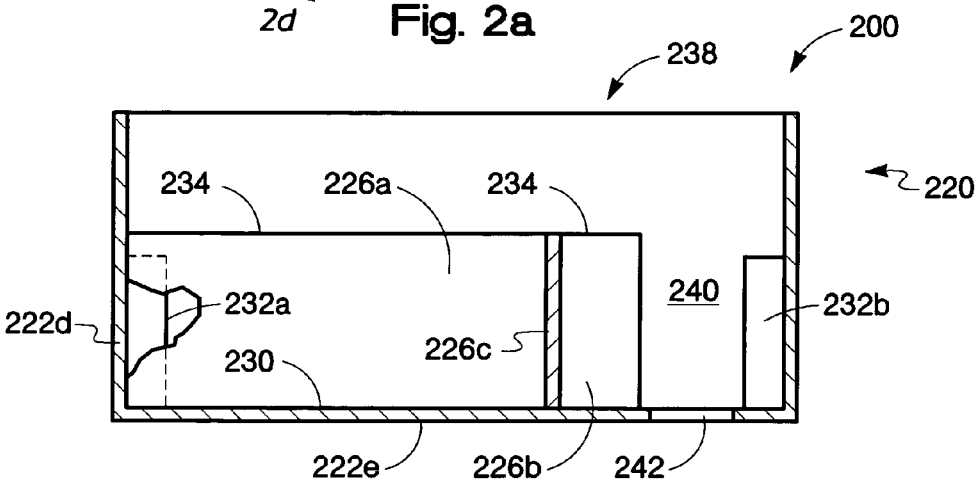
FIG. 2*b* is a cross-sectional view along 2*b*-2*b* of the fluid container shown in FIG. 2*a*.
Figure 2C:
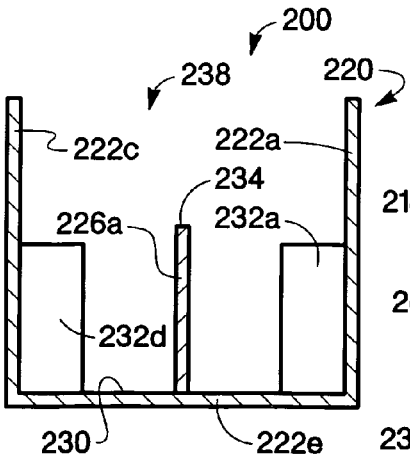
FIG. 2*c* is a cross-sectional view along 2*c*-2*c* of the fluid container shown in FIG. 2*a*.
Figure 2D:
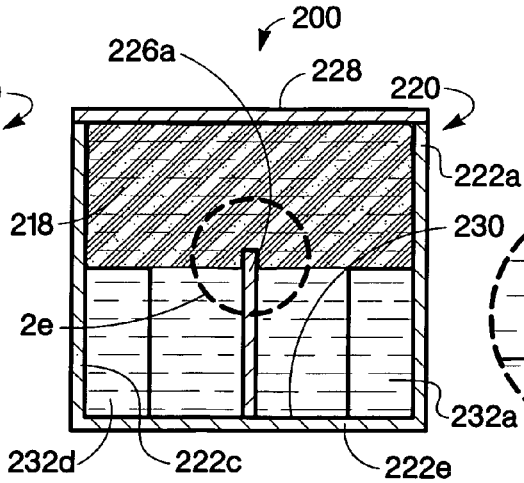
FIG. 2*d* is a cross-sectional view along 2*d*-2*d* of the fluid container shown in FIG. 2*a* with a capillary material disposed within the container and the container filled with a fluid according to an embodiment of the present invention.
Figure 2E:
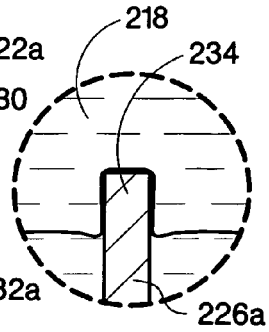
FIG. 2*e* is an expanded view showing the compression region formed by the free fluid compartment sidewall as illustrated in FIG. 2*d* according to an embodiment of the present invention.

In this embodiment, as illustrated in FIGS. 2*b*-2*d* the compartment sidewalls extend from bottom or base surface 230 of body 220 toward opening 238. The portion of the compartment sidewalls extending above capillary material stops 232*a*, 232*b*, 232*c*, and 232*d*, as shown in cross-sectional views in FIGS. 2*b*-2*d*, form compression edges 234. As illustrated in FIG. 2*d* capillary material stops 232*a*, 232*b*, 232*c*, and 232*d* limit the distance that capillary material 218 may be inserted into body 220. When the capillary material is fully inserted, into the body, compression edges 234 generate a compressive region in the capillary material proximate to the compression edges as illustrated, in an expanded cross-sectional view, in FIG. 2*e*. This compressive region increases the capillarity of the cells or pores in this region and thus reduces the possibility of an air path penetrating from one free fluid compartment to another. Free fluid compartment sidewall 226*a*, in this embodiment, is flush with, or at the same height with, free fluid compartment sidewalls 226*b* and 226*c* which also form a portion of outlet compartment 240. In this embodiment, compression edges 234 extend about 1 millimeter above the capillary material stops; however, in alternate embodiments, the compression edges may extend from about 0.5 millimeters to about 3 millimeters above the capillary material stops. The particular amount that the compression edges may extend will depend on various factors such as the particular material utilized for the capillary material, the surface tension of the fluid, the surface free-energy of the capillary material, and the localized compressibility of the capillary material in the region proximate to the compression edges.

Figure 1B:
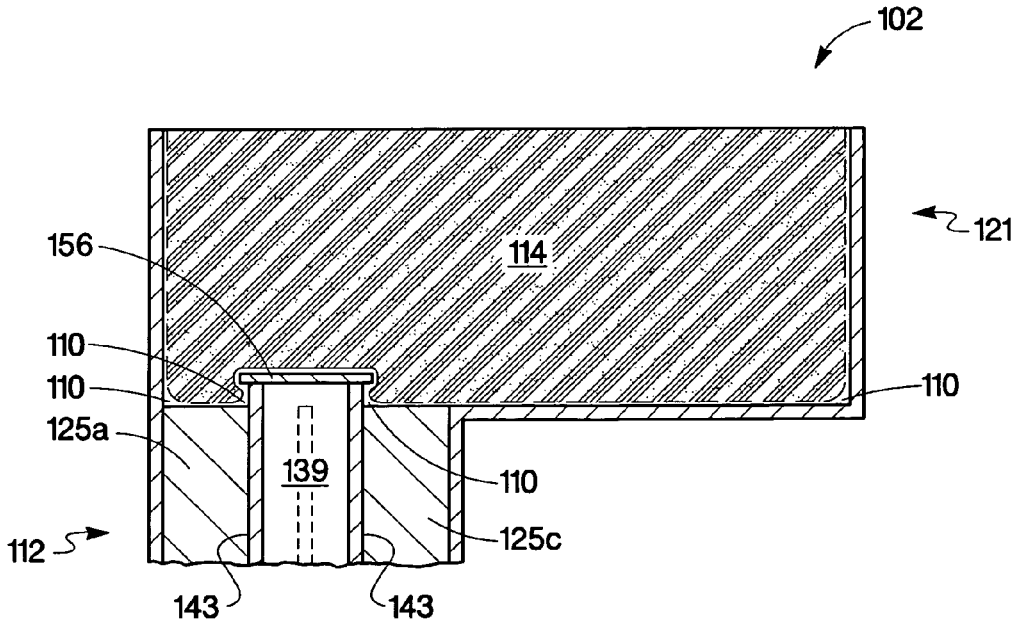
FIG. 1*b* is a cross-sectional view along 1*b*-1*b* of the print cartridge shown in FIG. 1*a*.
Figure 1C:
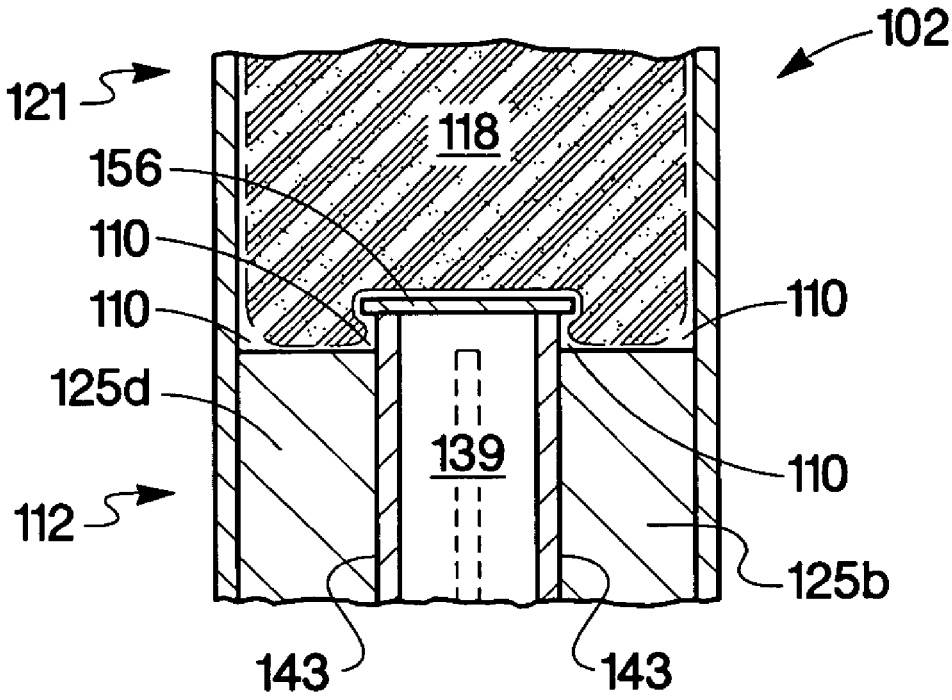
FIG. 1*c* is a cross-sectional view along 1*c*-1*c* of the print cartridge shown in FIG. 1*a*.

The structure of the present invention may be compared with print cartridge 102 shown in FIG. 1*c*. Print cartridge 102 includes standpipe supports 125*b* and 125*d* that extend from standpipe walls 143 to the peripheral walls of snout region 112 of cartridge body 121. In print cartridge 102 stand pipe supports are lower in height than the top of standpipe 139 onto which filter 156 is mounted. Thus, as illustrated in FIG. 1*c*, air gaps 110, generally, are formed between the top edge of the standpipe supports and capillary material 118 in the region of the intersection of standpipe supports 125*b* and 125*d* with standpipe walls 143, and air gaps 110 are also, generally, formed in the region of intersection with the peripheral walls of snout region 112. In FIGS. 1*b* and 1*c* the interface between the capillary material that is proximate to the air gaps is shown with a dashed line, whose dash length changes in certain regions solely for purposes of clarity. A gap between the capillary material and the support walls or compartment sidewalls that is greater than the nominal pore or cell size of the capillary material, allows air that finds a path into one free fluid compartment to continue to pass into an adjacent compartment.

As noted above and as shown in FIGS. 2*b*-2*c*, in the present invention the barrier between compartments is generated along compression edges 234, which form, in the capillary material due to the localized compression, a region of smaller-sized pores that have a bubble pressure greater than the backpressure in the fluid container. In the embodiment shown in FIGS. 2*a*-*e*, the radius of curvature in the plane of free fluid compartment sidewalls 226*a*, 226*b*, and 226*c* at the intersection with body sidewalls 222*d*, 222*a*, and 222*c* respectively is essentially square having a radius of curvature less than 0.1 millimeters. Fluid container 200 shown in FIGS. 2*a*-2*e* further includes cap or lid 228 having an air vent tube or labyrinth (not shown) formed in the lid for supplying or replenishing air to the internal volume as fluid is removed from the container. Lid 228 may have various ribs or other structures formed on the internal portion to further provide compression of capillary material 218 against compression edges 234 of the free fluid compartment sidewalls. In this embodiment, capillary material 218 is generally referred to as polyurethane foam; however, in alternate embodiments, other materials such as bonded polyester fiber (BPF), bonded polypropylene or polyethylene fibers, nylon fibers, or rayon fibers also may be utilized to form capillary material 218. Any material having a surface energy higher than the liquid being stored may be utilized including surface modified materials.

Figure 3A:
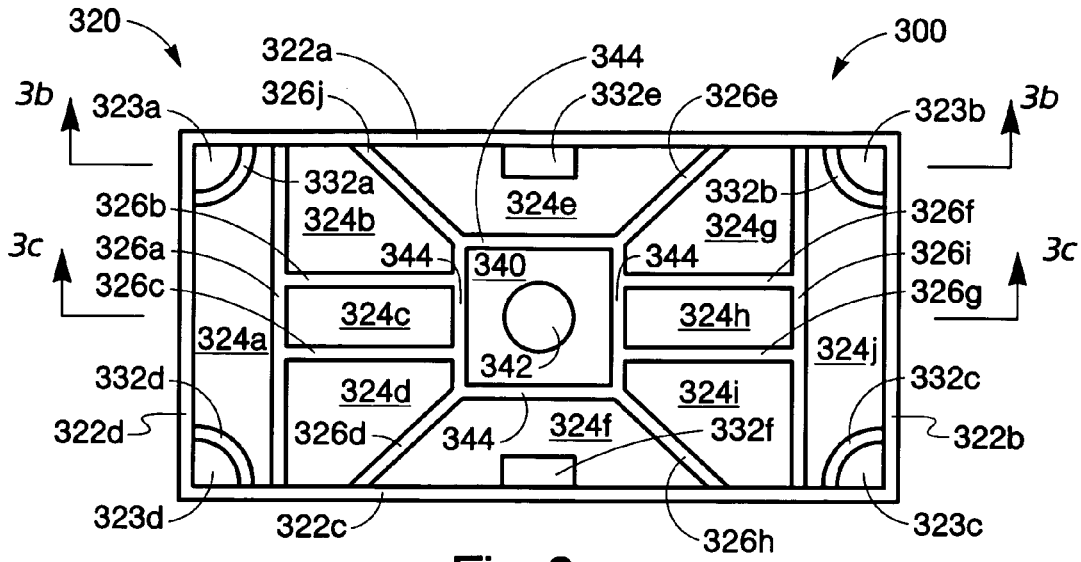
FIG. 3*a* is a top plan view of a fluid container according to an alternate embodiment of the present invention.

An alternate embodiment of a fluid container is shown in a top plan view in FIG. 3*a*. In this embodiment, fluid container 300 includes body 320 having peripheral walls 322*a*, 322*b*, 322*c*, and 322*d* formed by injection molding. Body 320, in this embodiment, includes capillary material stops 332*a*, 332*b*, 332*c*, and 332*d* having curved walls that extend between the two closest peripheral walls of body 320 forming capillary stop compartments 323*a*, 323*b*, 323*c*, and 323*d* in which additional free fluid may be stored. In addition, in this embodiment, body 320 further includes capillary material stop ledges 332*e* and 332*f*. The capillary material (not shown) is supported by the capillary material stops and ledges. In alternate embodiments, other structures may be utilized, such as a ledge that either entirely or partially circumscribes the peripheral walls of body 320, which advantageously reduces the volume of the structures utilized to form the stops so that the volume of free fluid which may be stored within fluid container 300 is maximized. The volume between container opening 338 and capillary material stop surfaces 333 forms capillary fluid volume 314.

Figure 3B:
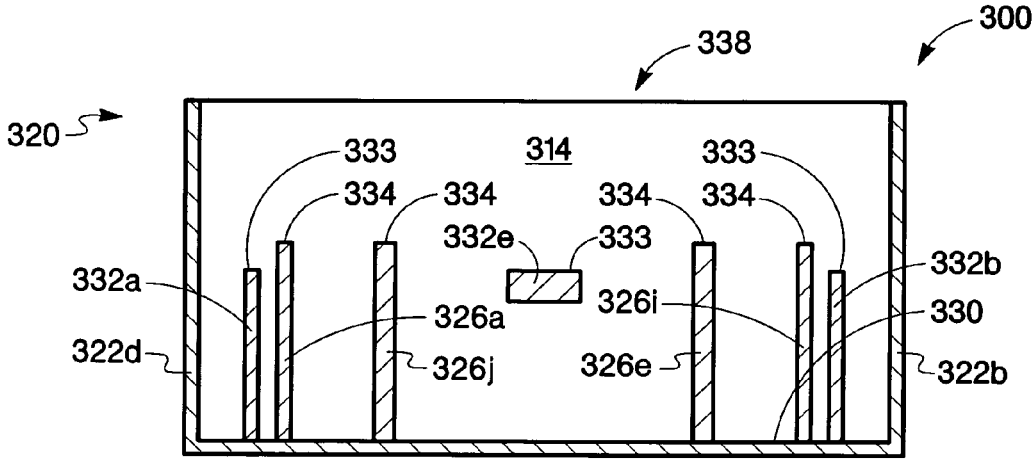
FIG. 3*b* is a cross-sectional view along 3*b*-3*b* of the fluid container shown in FIG. 3*a*.
Figure 3C:
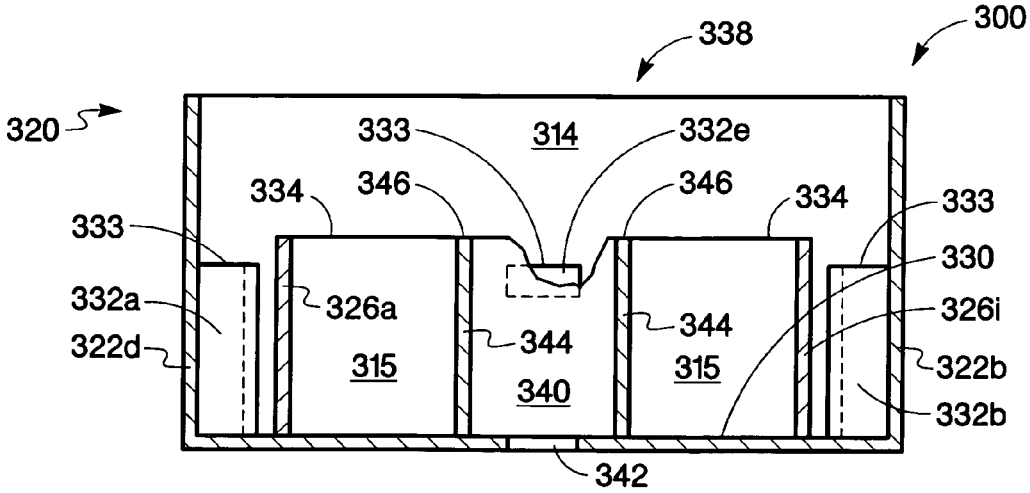
FIG. 3*c* is a cross-sectional view along 3*c*-3*c* of the fluid container shown in FIG. 3*a*.

In this embodiment, body 320 also includes free fluid volume 315 that is the volume between container base surface 330 and material stop surfaces 333 excluding the volume of fluid outlet 340. Free fluid volume 315, in this embodiment, is partitioned into 10 free fluid compartments labeled as 324*a*-324*j*. Each compartment includes at least one free fluid compartment sidewall 326*a*-326*j*. Body 320 further includes outlet compartment 340 formed by outlet compartment walls 344 and also includes fluid outlet 342 through which fluid held in container 300 is dispensed. Each free fluid compartment sidewall is flush with outlet wall surface 346 of outlet compartment walls 344, where the region of each free fluid compartment sidewall that extends above capillary material stop surfaces 333 forms compression edges 334 as illustrated in a cross-sectional view in FIGS. 3*b* and 3*c*.

Figure 4A:
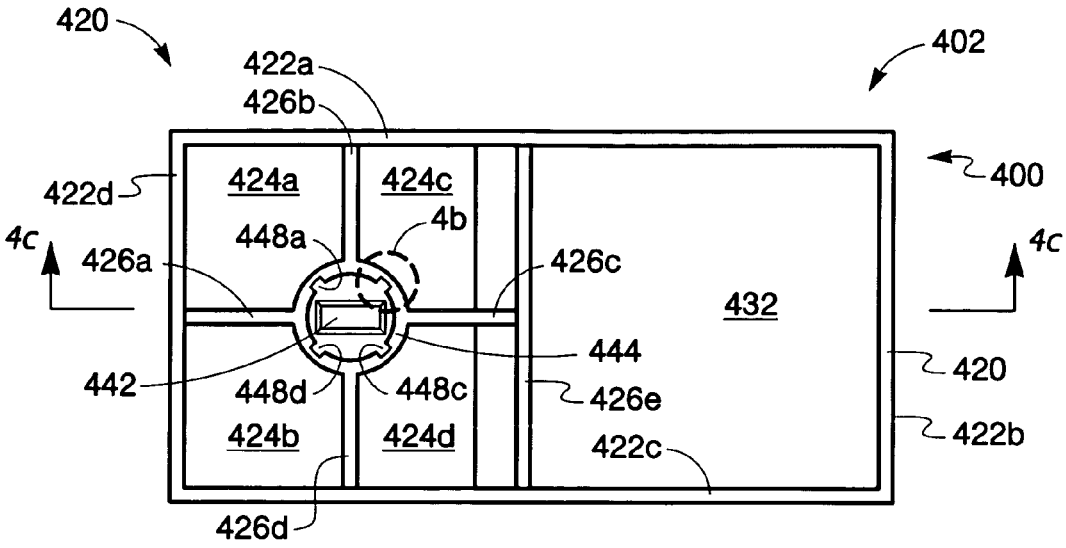
FIG. 4*a*. is a top plan view of a fluid ejection cartridge according to an alternate embodiment of the present invention.
Figure 4B:
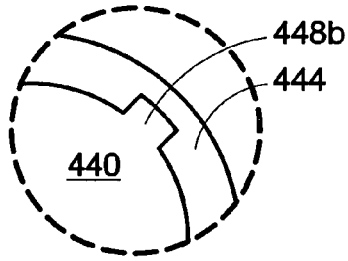
FIG. 4*b* is an expanded top plan view of a portion of the outlet compartment of the alternate embodiment shown FIG. 4*a*.

An alternate embodiment of the present invention is shown in a top plan view in FIG. 4*a* where fluid container 400 is an integral part of fluid ejection cartridge 402. In this embodiment, fluid ejection cartridge 402 includes cartridge body 420 having peripheral walls 422*a*, 422*b*, 422*c*, 422*d*, 422*e* (see FIG. 4*c*), 422*f* (see FIG. 4*c*), and 422*g* (see FIG. 4*c*) where the internal surface of peripheral wall 422*e* forms capillary material stop 432. The volume between cartridge lid 428 (see FIG. 4*c*) and capillary material stop surface 433 forms capillary fluid volume 414. Cartridge body 420 also includes free fluid volume 415 that is the volume between internal cartridge base surface 430 and capillary material stop surface 433 excluding the volume of fluid outlet 440. Free fluid volume 415, in this embodiment, is partitioned into free fluid compartments 424*a*, 424*b*, 424*c*, and 424*d*. Each compartment includes at least one free fluid compartment sidewall 426*a*-426*e*. Cartridge body 420 further includes cylindrically shaped standpipe 440 formed by standpipe wall 444. Standpipe 440 typically includes a filter (not shown) mounted to standpipe wall surface 446 to provide filtration of air bubbles and solid particles when fluid flows from the capillary material (not shown) into standpipe 440. In this embodiment, standpipe wall 444 has 4 recessed grooves 448*a*, 448*b*, 448*c*, and 448*d* that provide separate conduits to transmit fluid between the capillary material, that is in intimate contact with the filter, and standpipe 440. These recessed grooves extend over a substantial length of standpipe 440. In this embodiment, the recessed grooves have a rectangular cross-section; however, in alternate embodiments, any non-circular or non-smoothly rounded interior cross-section may be utilized. The vertex or corner regions along the length of the recessed grooves define bypass channels that function to allow fluid flow past a large bubble that may form in the standpipe and effectively block fluid flow. The addition of the recessed grooves limits the expansion of any large bubble into the recessed grooves which remain filled with fluid to maintain a continuous fluid path between fluid container 400 and outlet 442. The fluid surface tension will substantially hinder an air bubble from completely filing the recessed groove so long as the width of the groove is less than $8(\gamma)/P$ where $\gamma$ is the surface tension of the fluid and P is the internal pressure of the bubble assuming the bubble is characterized as cylindrical in shape. In this embodiment, the width of the recessed grooves is less than about 0.5 millimeters with a depth in the range from about 0.35 millimeters to about 0.46 millimeters. In alternate embodiments, cylindrically shaped free fluid compartments having recessed grooves may also be utilized in free fluid volume 415 to provide a wide variety of compartment geometries that may be utilized in the present invention.

At the base of standpipe 440 fluid outlet 442 provides a fluidic orifice through which fluid held in cartridge body 420 is fluidically coupled to printhead substrate 450 via fluid flow channel 452. Printhead substrate 450 may be any of the wide variety of fluid ejector heads known in the art such as thermal resistor, piezoelectric, flex-tensional, acoustic, and electrostatic. In this embodiment, printhead substrate 450 is a thermal resistor type fluid ejector having a plurality of thermal resistors formed on printhead substrate 450 and a plurality of orifices or nozzles in fluid communication with the thermal resistors.

Figure 4C:
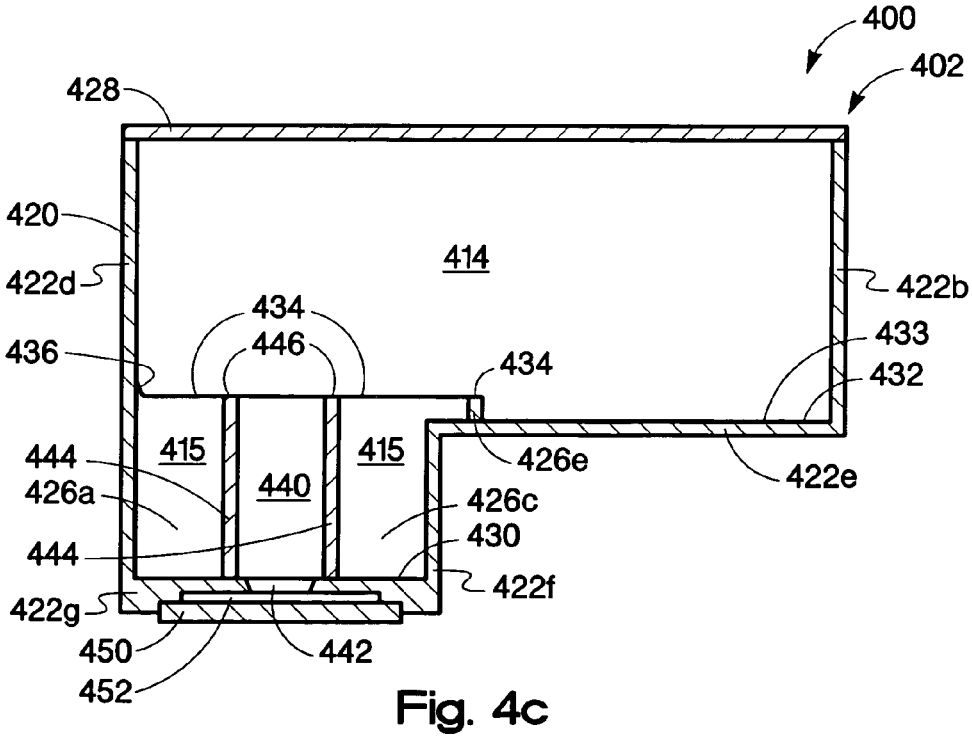
FIG. 4*c* is a cross-sectional view along 4*c*-4*c* of the fluid ejection cartridge shown in FIG. 4*a*.

In this embodiment, each free fluid compartment sidewall is flush with the top standpipe wall 444, where the region of each free fluid compartment sidewall that extends above capillary material stop surface 433 forms compression edges 434 as illustrated in a cross-sectional view in FIG. 4*c*. In addition, in this embodiment, the radius of curvature in the plane of free fluid compartment sidewalls 426*a*, 426*b*, and 426*d* at the intersection with peripheral walls 422*d*, 422*a*, and 422*c* respectively is curved upward toward lid 428 having a radius of curvature of 1 millimeters forming compression shoulder 436. In alternate embodiments, the radius of curvature may be in the range from about 0.25 millimeters to about 2.5 millimeters. The geometric configuration of the peripheral walls of cartridge body 420 and the spacing between the capillary material and the peripheral walls generally provides the most advantageous path for air leakage into the free fluid compartments. The addition of a radius of curvature proximate to the peripheral walls provides increased protection against leakage of air between two adjacent compartments in this region.

Figure 5A:
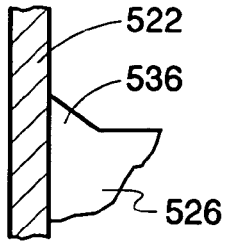
FIGS. 5*a*-5*b* are cross-sectional views of compression shoulders of a free fluid compartment sidewall according to alternate embodiments of the present invention.
Figure 5B:
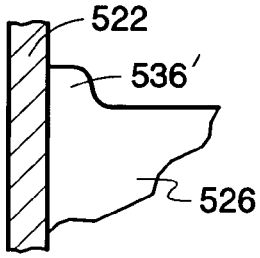

Alternate embodiments of a compression shoulder that may be utilized in the various embodiments of the present invention are shown in expanded cross-sectional views in FIGS. 5*a*-5*b*. In FIG. 5*a* compression shoulder 536, formed on compartment sidewall 526, decreases linearly moving away from body sidewall 522 of the container or cartridge body. In FIG. 5*b* compression shoulder 536' forms a tab at the sidewall of the container or cartridge body. The particular length over which the compression shoulder extends and the particular height of the compression shoulder will depend on various factors such as the compression characteristics of the capillary material, the surface free energy of the capillary material, the surface tension of the fluid, the geometric configuration of the walls and the typical gap between the walls and the capillary material.

Figure 5C:
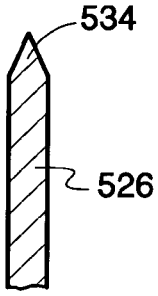
FIGS. 5*c*-5*e* are cross-sectional views of compression edges of a free fluid compartment sidewall according to alternate embodiments of the present invention.
Figure 5D:
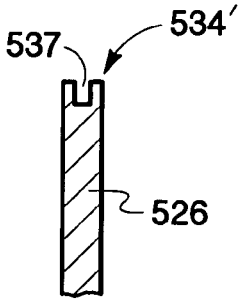
Figure 5E:
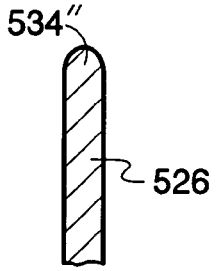

Alternate embodiments of the compression edge of the free fluid compartment sidewalls that may be utilized in the various embodiments of the present invention are shown in expanded cross-sectional views in FIGS. 5*c*-5*e*. In FIG. 5*c*, compartment sidewall 526 includes compression edge 534 that has a knife edge cross section, which provides for the highest compression of the capillary material at the apex of the knife edge. In FIG. 5*d*, compression edge 534' includes compression channel 537 that runs parallel with the compression edge. In FIG. 5*e* compression edge 534" includes a fully rounded edge. These embodiments provide a few examples of the wide variety of geometrical shapes that may be utilized to form the compression edge in the present invention.

Figure 5F:
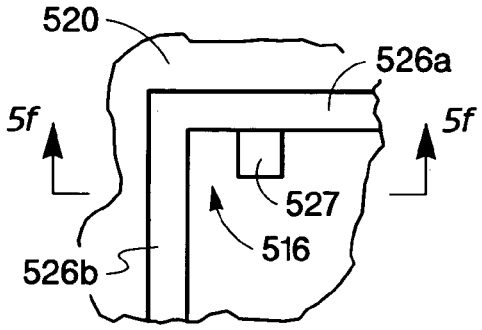
FIG. 5*f* is top plan view of the intersection of two free fluid compartment sidewalls according to an alternate embodiment of the present invention.
Figure 5G:
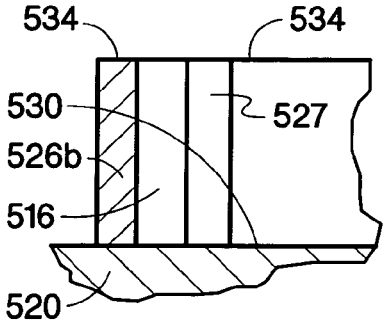
FIG. 5*g* is a cross-sectional view along 5*g*-5*g* of the two free fluid compartment sidewalls shown in FIG. 5*f*.

An alternate embodiment of the intersection between two free fluid compartment sidewalls that may be utilized in various embodiments of the present invention is shown in a top plan view in FIG. 5*f*. In this embodiment, free fluid compartment sidewall 526*a* intersects with free fluid compartment sidewall 526*b* at an angle of ninety degrees. In addition, sidewall projection 527 having a rectangular cross-section extends out from free fluid compartment sidewall 526*a* proximate to free fluid compartment sidewall 526*b* forming fluid capillary channel 516 between sidewall 526*b* and projection 527. Fluid capillary channel 516 extends from base surface 530 of body 520 to compression edge 534 of free fluid compartment sidewall 526*a* providing a capillary channel for conducting free fluid from the base or bottom of a free fluid compartment to the capillary material as illustrated, in a cross-sectional view, in FIG. 5*g*.

Figure 6A:
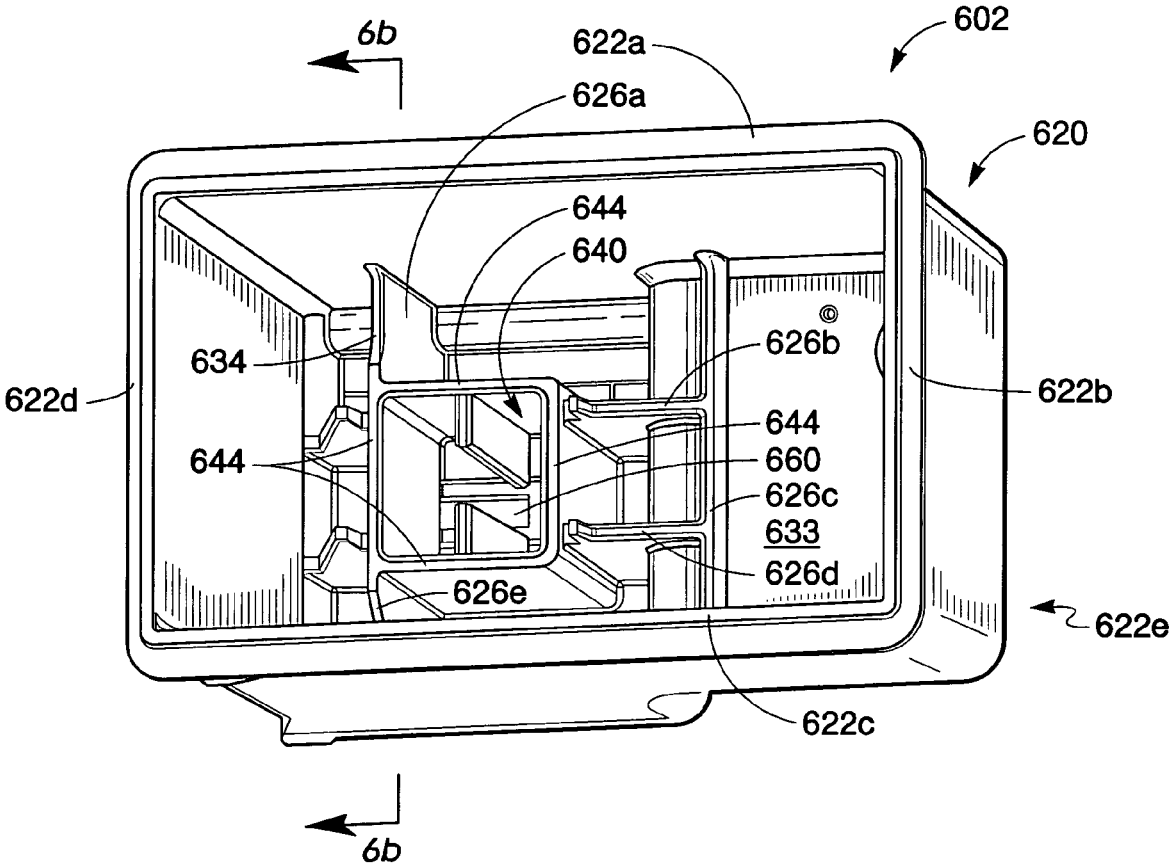
FIG. 6*a* is perspective view of a fluid ejection cartridge according to an alternate embodiment of the present invention.

An exemplary embodiment of the present invention is shown in a perspective view in FIG. 6*a*. In this embodiment, fluid ejection cartridge 602 includes cartridge body 620 having peripheral walls 622*a*, 622*b*, 622*c*, 622*d*, and 622*e* where the internal surface of peripheral wall 622*e* forms capillary material stop surface 633. The volume between container opening 638 and capillary material stop surface 633 forms capillary fluid volume 614 (see FIG. 6*b*). Cartridge body 620 also includes free fluid volume 615 (see FIG. 6*b*) that is the volume between internal cartridge base surface 630 and capillary material stop surface 633 excluding the volume of fluid outlet 640. Free fluid volume 615, in this embodiment, is partitioned into five free fluid compartments formed by compartment sidewalls 626*a*, 626*b*, 626*c*, 626*d* and 626*e*. Cartridge body 620 further includes square shaped fluid outlet 640 formed by outlet walls 644. Fluid outlet 640 also includes fluid feed slot 660 formed in bottom body sidewall 622*g* through which fluid held in fluid ejection cartridge 602 is dispensed to the printhead substrate (not shown).

Figure 6B:
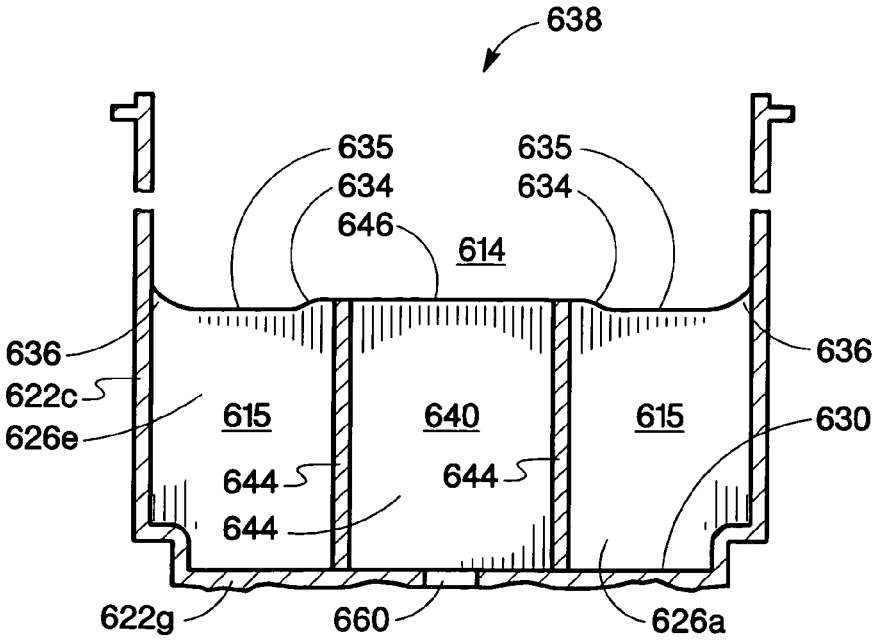
FIG. 6*b* is a cross-sectional view along 6*b*-6*b* of the fluid ejection cartridge shown in FIG. 6*a*.

As illustrated in a cross sectional view in FIG. 6*b*, in this embodiment, sidewalls 626*a* and 626*e* each have compression edges 634 that vary in elevation or height in moving from outlet walls 644 to peripheral walls 622*a* and 622*c* respectively. In this embodiment, compression edges 634 of sidewalls 626*a* and 626*e* are each flush in elevation with their respective outlet wall surface 646 of outlet walls 644, moving from the outlet wall toward the peripheral wall compression edges 634 each smoothly decrease in height reaching a minimum elevation in concave region 635. In this embodiment, the change in elevation between the outlet wall and the point of minimum elevation is about 0.5 millimeters; however, in alternate embodiments, other values, generally in the range from about 0.3 millimeters to about 1 millimeter also may be utilized. The particular value will depend on various factors such as the compression characteristics of the capillary material, the surface free energy of the capillary material, the surface tension of the fluid, the geometric configuration of the walls and the typical gap between the walls and the capillary material. Continuing toward peripheral wall the compression edges smoothly increase in height ending with compression shoulder 636 formed in the compression edge of the compartment sidewall at the intersection with the peripheral wall. In this embodiment, compression shoulder 636 has a radius of curvature of 2 millimeters; however, in alternate embodiments, the radius of curvature may vary from about 0.5 millimeters to about 3 millimeters. By varying the elevation of the compartment sidewall the amount or degree of compression of the capillary material, along the compression edge, may be varied. For example, the compression characteristics of the capillary material may be taken into account to produce a compression region having uniform compression over the entire length of the sidewall. Alternatively, the elevation may be varied to generate a region of high compression in the region of the outlet wall and the peripheral wall with a region of lower compression formed between these two regions of high compression.

Figure 7A:
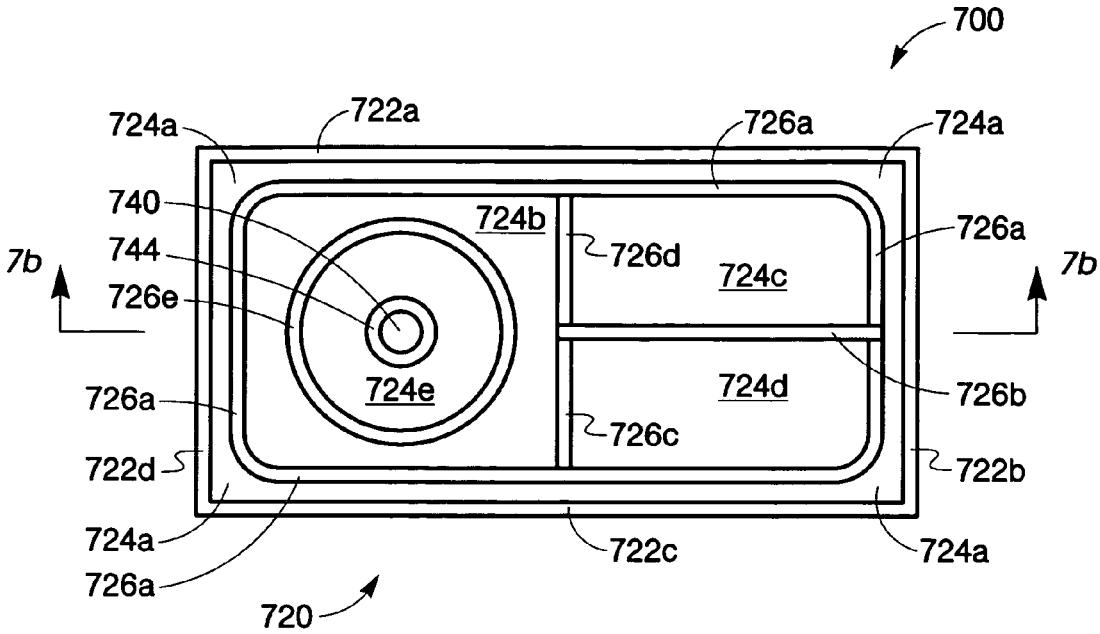
FIG. 7*a* is a top plan view of a fluid container according to an alternate embodiment of the present invention.
Figure 7B:
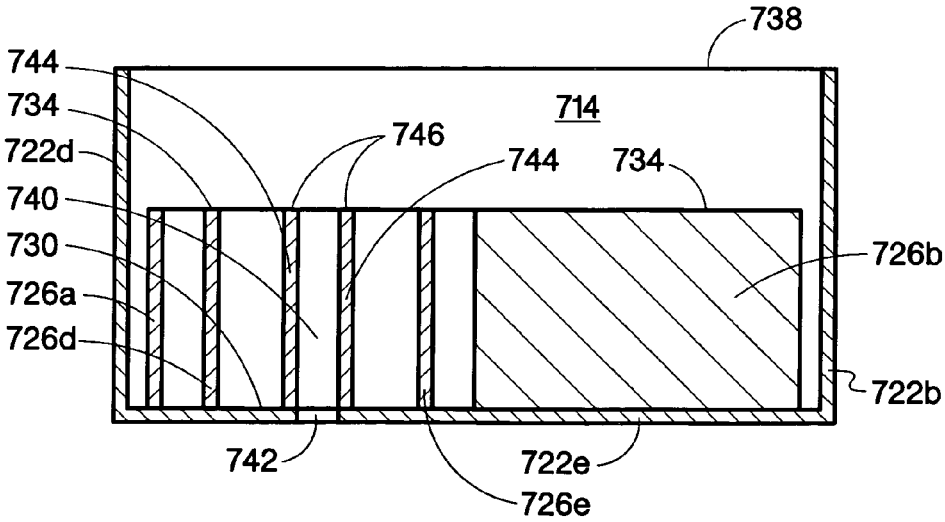
FIG. 7*b* is a cross-sectional view along 7*b*-7*b* of the fluid container shown in FIG. 7*a*.

Another exemplary embodiment of the present invention is shown in a top plan view in FIG. 7*a*. In this embodiment, fluid container 700 includes body 720 having peripheral walls 722*a*, 722*b*, 722*c*, 722*d*, and 722*e* (see FIG. 7*b*) where the internal surface of peripheral wall 722*e* forms base surface 730. Free fluid compartment 724*a* is formed by peripheral walls 722*a*-722*d* and circumjacent compartment sidewall 726*a*. Free fluid compartment 724*b* is formed by compartment sidewall 726*a*, cylindrical sidewall 726*e* and straight sidewalls 726*d* and 726*c*. Free fluid compartment 724*c* is formed by compartment sidewall 726*a* and straight sidewalls 726*b* and 726*d*, whereas free fluid compartment 724*d* includes compartment sidewall 726*a* and straight sidewalls 726*b* and 726*c*. Free fluid compartment 724*e* is formed between cylindrical sidewall 726*e* and cylindrical outlet wall 744. Outlet fluid compartment 740, in this embodiment, is formed by cylindrical outlet wall 744. In addition, fluid outlet compartment 740 also includes fluid outlet 742 formed in peripheral wall 722*e* through which fluid stored in fluid container 700 is dispensed. In this embodiment, each free fluid compartment is also bounded by peripheral wall 722*e* and capillary fluid volume 714 as illustrated in a cross-sectional view in FIG. 7*b*. Free fluid compartment sidewalls 726*a*-726*e* as well as cylindrical outlet wall 744 extend from base surface 730 to capillary fluid volume 714. In this embodiment, compression edges 734 of each compartment sidewall are flush with outlet wall surface 746 of outlet wall 744. Each compression edge of the free fluid compartment sidewalls generates a compressive region in the capillary material (not shown) proximate to the compression edges as described above. In this embodiment, compression edges 734 act as capillary material stops limiting the distance the capillary material may be inserted into body 720 of fluid container 700. In alternate embodiments, compression edges 734 may be lower in height than outlet hall surface 746 but extend sufficiently into capillary fluid volume to form a compressive region in the capillary material (not shown). As described above, the region between the capillary material and the peripheral walls typically is the dominant path for air leakage to a particular free fluid compartment. Thus, by utilizing free fluid compartment sidewall 726*a* to form free fluid compartment 724*a* having a narrow gap between and circumjacent to the peripheral walls of body 720, typically, the fluid uptake of the capillary material upon creation of the first air leakage path is substantially limited to the volume contained in free fluid compartment 724*a*.

What is claimed is:

1. A fluid container, comprising:

a body having:

a base surface;

a capillary fluid volume disposed over said base surface;

an outlet compartment having at least one outlet wall disposed within said body, said at least one outlet wall having an outlet wall edge extending into said capillary fluid volume; and at least two fluidically segregated free fluid compartments, each free fluid compartment having at least one sidewall disposed within said body, said at least one sidewall having a compression edge, wherein at least a portion of said compression edge is flush with said at least one outlet wall edge.

2. The fluid container in accordance with claim 1, wherein said fluid container further comprises a capillary material stop disposed in said body.

3. The fluid container in accordance with claim 2, wherein said capillary material stop further comprises a capillary material stop compartment adapted to hold free fluid.

4. The fluid container in accordance with claim 2, wherein said capillary material stop further comprises a capillary material stop ledge disposed on at least one peripheral wall of said body.

5. The fluid container in accordance with claim 4, wherein said capillary material stop ledge partially circumscribes said at least one peripheral wall.

6. The fluid container in accordance with claim 2, wherein said compression edge extends a distance from about 0.5 millimeters to about 3 millimeters above said capillary material stop.

7. The fluid container in accordance with claim 1, wherein said at least one sidewall further comprises said at least one sidewall having an intersection with said at least one outlet wall, wherein said compression edge is flush with said at least one outlet wall edge at said intersection.

8. The fluid container in accordance with claim 1, wherein said compression edge extends a distance from about 0.5 millimeters to about 3 millimeters into said capillary fluid volume.

9. The fluid container in accordance with claim 1, wherein said compression edge extends into said capillary fluid volume over the entire length of said at least one sidewall.

10. The fluid container in accordance with claim 1, wherein said compression edge further comprises a knife edge.

11. The fluid container in accordance with claim 1, wherein said compression edge further comprises a compression channel formed in said compression edge.

12. The fluid container in accordance with claim 1, wherein said compression edge further comprises a fully rounded edge.

13. The fluid container in accordance with claim 1, wherein said body further comprises a peripheral body wall having an intersection with said at least one sidewall, and wherein said at least one sidewall further comprises a compression shoulder disposed on said compression edge at said intersection.

14. The fluid container in accordance with claim 13, wherein said compression edge further comprises a concave region disposed between said outlet wall and said compression shoulder.

15. The fluid container in accordance with claim 1, wherein said at least one sidewall further comprises a compression shoulder disposed on said compression edge.

16. The fluid container in accordance with claim 15, wherein said compression shoulder linearly decreases in elevation in moving away from said peripheral body wall.

17. The fluid container in accordance with claim 15, wherein said compression shoulder has a radius of curvature.

18. The fluid container in accordance with claim 17, wherein said radius of curvature increases in elevation moving toward said peripheral body wall.

19. The fluid container in accordance with claim 17, wherein said radius of curvature is in the range from about 0.25 millimeters to about 3.0 millimeters.

20. The fluid container in accordance with claim 17, wherein said radius of curvature is in the plane formed by said at least one sidewall.

21. The fluid container in accordance with claim 15, wherein said compression shoulder further comprises a tab structure.

22. The fluid container in accordance with claim 1, wherein said body further comprises a peripheral body wall having an intersection with said at least one sidewall, and wherein said compression edge further comprises a concave region disposed between said outlet wall and said peripheral body wall.

23. The fluid container in accordance with claim 1, wherein at least one of said at least two fluidically segregated free fluid compartments further comprises two sidewalls, said two sidewalls having an intersection at a 90 degree angle, said intersection forming a capillary channel extending from said base surface to said capillary fluid volume, and each sidewall having a compression edge proximate to said capillary fluid volume.

24. The fluid container in accordance with claim 1, wherein said compression edge forms a compressed region in a capillary material disposed in said capillary fluid volume.

25. The fluid container in accordance with claim 24, wherein said compressed region further comprises pores having a bubble pressure greater than a pre-selected back pressure of the fluid container.

26. The fluid container in accordance with claim 24, wherein said sidewall further comprises a sidewall length, and said compressed region is uniform over said sidewall length.

27. The fluid container in accordance with claim 24, wherein said compressed region further comprises a first region of high compression proximate to said at least one outlet wall and a second region of high compression proximate to a peripheral wall of said body.

28. The fluid container in accordance with claim 1, wherein at least one of said at least two fluidically segregated free fluid compartments further comprises two sidewalls, said two sidewalls having an intersection at an angle less than about 120, degrees, said intersection forming a capillary channel extending from said base surface to said capillary fluid volume, and each sidewall having a compression edge proximate to said capillary fluid volume.

29. The fluid container in accordance with claim 1, further comprising a lid fluidically sealed to said body over said opening.

30. The fluid container in accordance with claim 29, wherein said lid further comprises a vapor-barrier labyrinth vent.

31. A fluid ejector cartridge, comprising:

a fluid container of claim 1; and a fluid ejector head disposed on said body, wherein said outlet is in fluid communication with said fluid ejector head.

32. The fluid container in accordance with claim 1, wherein said at least one sidewall further comprises an intersection with a second sidewall, wherein said intersection is at an angle less than about 120 degrees.

33. The fluid container in accordance with claim 32, wherein said at least one sidewall further comprises a compression shoulder disposed on said compression edge at said intersection.

34. The fluid container in accordance with claim 1, wherein said at least one sidewall further comprises two sidewalls having an intersection with each other, and each sidewall having an elevation flush with the other sidewall at said intersection.

35. The fluid container in accordance with claim 34, wherein said intersection forms a capillary channel extending from said base surface to said capillary fluid volume.

36. The fluid container in accordance with claim 1, wherein said body further comprises at least one free fluid compartment bounded by a cylindrical wall extending from said base surface to said capillary fluid volume, said cylindrical wall having at least one recessed groove formed therein and extending from said base surface to said capillary fluid volume.

37. The fluid container in accordance with claim 1, wherein said outlet compartment further comprises an outlet compartment formed by a cylindrical wall, said cylindrical wall having at least one recessed groove formed in an inside surface of said cylindrical wall and extending from said base surface to said capillary fluid volume.

38. The fluid container in accordance with claim 37, wherein said at least one recessed groove further comprises said recessed groove having a rectangular cross-section.

39. The fluid container in accordance with claim 37, wherein said at least one recessed groove further comprises a width less than about 0.5 millimeters.

40. The fluid container in accordance with claim 39, wherein said at least one recessed groove further comprises a depth in the range from about 0.35 millimeters to about 0.46 millimeters.

41. The fluid container in accordance with claim 1, wherein said at least one sidewall further comprises said at least one sidewall laterally extending to a peripheral body wall.

42. The fluid container in accordance with claim 1, further comprising a filter mounted to said at least one outlet wall proximate to said capillary fluid volume.

43. The fluid container in accordance with claim 1, wherein said body further comprises a peripheral body wall, wherein said at least one sidewall is circumjacent to said peripheral body wall.

44. The fluid container in accordance with claim 43, wherein said at least one sidewall is proximate to said peripheral body wall.

45. The fluid container in accordance with claim 1, further comprising a capillary material.

46. The fluid container in accordance with claim 45, wherein said capillary material has a surface free energy greater than the surface tension of a fluid held in said container.

47. The fluid container in accordance with claim 45, wherein said capillary material has a surface free energy greater than the surface free energy of a fluid held in said container.

48. The fluid container in accordance with claim 1, wherein said at least one sidewall further comprises a sidewall projection forming a fluid capillary channel.

49. The fluid container in accordance with claim 1, wherein said at least one sidewall further comprises a fluid capillary channel formed therein and extending from said base surface to said capillary fluid volume.

50. A method of making a fluid ejector cartridge, comprising:

making a fluid container of claim 1; and attaching a fluid ejector head to said body, wherein said outlet is in fluid communication with said fluid ejector head.

51. A fluid container, comprising:

a base surface;

means for forming a capillary fluid volume disposed over said base surface;

means for providing a fluid outlet having at least one outlet wall extending into said means for forming a capillary fluid volume;

at least two fluidically segregated free fluid compartments in fluid communication with said means for forming a capillary fluid volume; and means for hindering air leakage paths between said at least two fluidically segregated free fluid compartments.

52. The fluid container in accordance with claim 51, further comprising means for hindering insertion of a capillary material beyond a pre-selected distance into said container.

53. A fluid container, comprising:

at least one peripheral wall;

a capillary fluid volume disposed in the fluid container;

an outlet compartment having at least one outlet wall disposed within the fluid container, said at least one outlet wall having an outlet wall edge extending into said capillary fluid volume;

a first free fluid compartment having at least one sidewall circumjacent to and proximate to said at least one peripheral wall, said at least one sidewall having a compression edge, said compression edge extending into said capillary fluid volume; and a second free fluid compartment disposed within said first free fluid compartment and fluidically segregated from said first free fluid compartment.

54. A fluid container, comprising:

an internal surface;

a capillary fluid volume disposed over said internal surface;

an outlet compartment having an outlet wall disposed within the fluid container, said outlet wall having an outletwall edge extending into said capillary fluid volume; and at least two fluidically segregated free fluid compartments disposed within the fluid container, each free fluid compartment having a sidewall, said sidewall having a compression edge, wherein at least a portion of said compression edge is flush with said outletwall edge.

55. A method of making a fluid container, comprising:

forming a body having a base surface;

forming an outlet compartment having at least one outlet wall formed within said body, said at least one outlet wall having an outlet wall edge extending into a capillary fluid volume disposed within said body; and forming at least two fluidically segregated free fluid compartments within said body, each free fluid compartment having at least one sidewall formed within said body, said at least one sidewall having a compression edge, wherein at least a portion of said compression edge is flush with said at least one outlet wall edge.

56. The method in accordance with claim 55, further comprising inserting a capillary material into the fluid container.

57. The method in accordance with claim 55, further comprising forming a capillary material stop within said body.

58. The method in accordance with claim 55, further comprising forming a capillary fluid channel in said at least one sidewall.

59. The method in accordance with claim 55, further comprising forming a recessed groove in said outlet wall.

60. The method in accordance with claim 55, further comprising forming said at least one sidewall circumjacent to a peripheral wall of said body.

61. A fluid container, comprising:

a body having:

a base surface;

a capillary fluid volume disposed over said base surface;

an outlet compartment having at least one outlet wall disposed within said body, said at least one outlet wall having an outlet wall edge extending into said capillary fluid volume; and at least two fluidically segregated free fluid compartments fluidically coupled to said outlet compartment, each free fluid compartment having at least one sidewall disposed within said body, said at least one sidewall having a compression edge, wherein a portion of said compression edge is flush with said at least one outlet wall edge, and wherein said at least two fluidically segregated free fluid compartments have a volume at least 10% of said capillary fluid volume.

62. A fluid container, comprising:

a body having:

a base surface;

a capillary fluid volume disposed over said base surface;

an outlet compartment having at least one outlet wall disposed within said body, said at least one outlet wall having an outlet wall edge extending into said capillary fluid volume; and at least two fluidically segregated free fluid compartments, each free fluid compartment having at least one sidewall disposed within said body, said at least one sidewall forming a dimension of said free fluid compartment, wherein said at least one sidewall has a compression edge along the entire dimension of said free fluid compartment, and wherein at least a portion of said compression edge is flush with said at least one outlet wall edge.

* * * * *